US005100769A

United States Patent [19]

Westfal et al.

[11] Patent Number: 5,100,769

[45] Date of Patent: Mar. 31, 1992

[54] PAPER SUPPORT FOR LIGHT-SENSITIVE MATERIALS WITH AN ANTI-CURL LAYER ON THE BACKSIDE

[75] Inventors: Horst Westfal, Belm; Andreas Diekmann, Hagen, both of Fed. Rep. of Germany

[73] Assignee: Felix Schoeller Jr. GmbH & Co. KG, Osnabruck, Fed. Rep. of Germany

[21] Appl. No.: 510,303

[22] Filed: Apr. 16, 1990

[30] Foreign Application Priority Data

May 5, 1989 [EP] European Pat. Off. ..... 89 108 096

[51] Int. Cl.[5] ..... G03C 1/76

[52] U.S. Cl. ..... 430/523; 430/538; 430/539; 430/930

[58] Field of Search ..... 430/523, 930, 538, 539

[56] References Cited

U.S. PATENT DOCUMENTS 3,227,578 1/1966 Malcolm ..... 430/930
3,515,555 10/1971 Grabhofer et al. ..... 430/930
3,549,375 12/1970 Pechmann ..... 430/930

*Primary Examiner*—Jack P. Brammer
*Attorney, Agent, or Firm*—Sprung Horn Kramer & Woods

[57] ABSTRACT

A water proof support material for light-sensitive materials with an anti-curl layer on the backside, the anti-curl layer comprising at least:

(a) a protein binder,
(b) a reaction product of triazine and formaldehyde,
(c) an N-methylol compound, and
(d) an aliphatic polyhydric alcohol.

5 Claims, No Drawings

PAPER SUPPORT FOR LIGHT-SENSITIVE MATERIALS WITH AN ANTI-CURL LAYER ON THE BACKSIDE

The present invention relates to a support material for light-sensitive materials with an anti-curl layer on the backside as well as a process for the manufacture of a support material for light-sensitive materials with an anti-curl coating on the backside.

Most photographic materials utilize gelatine as a substance to form the silver halide emulsions, the protective coatings and the backside coatings. The problem here is gelatine layers swell when they come into contact with water and prove to be of very low mechanical strength when in a swollen condition. They are therefore normally hardened using suitable hardening agents. The hardening agents crosslink the gelatine molecules with each other and thereby cause a decrease of water absorption or swelling capacity of the layer, an increase in the melting point and an improvement in the mechanical strength of the gelatine layer. Hardened gelatine layers are above all resistant to photographic development fluids.

The light-sensitive gelatine-containing layers on the front side of the support material are mostly matched by gelatine-containing coats on the backside. The application of the same binding agent gelatine on both sides of the support material serves the purpose of keeping the swelling characteristics of both layers more or less identical in the photographic development baths and the following drying processes so that the support material retains a good degree of flatness during the whole working process, the drying and the later utilization of the photograph/finished product.

The layers applied to the backside are therefore known as anti-roll-, anti-curl- or non-curling layers. The thickness of the backside layer is dependant on the swelling characteristics and the layer thickness of the layer used on the front side.

Such anti-curl layer usually contains various additives. These may be: wetting agents such as Saponin, matting agents such as silicic acids, softeners such as glycerine, organic acids such as citric acid as well as small quantities of other water-soluble high polymer compounds such as polyvinyl alcohol or antistatic agents such as sodium nitrate.

The resistance of the anti-curl layers to photographic development baths is achieved by the hardening of the gelatine with so-called hardening agents.

The more well-known hardening agents for gelatine include chromium (III) salts, aldehyde, N-methylol compounds, dialdehyde polysaccharide, polyfunctional epoxides, aziridine, polyfunctional vinyl compounds, triacrylic dimethoxymethane, substituted dichloro-s-triazine and others as described and found in chapter 2 of the book "The Theory of the Photographic Process" by T. H. James (London, 1977).

The hardening agents are added to the gelatine solution before the coating or are spread onto a gelatine layer as a special solution when the gelatine layer has already been applied to a support material. In the latter-mentioned case the hardening agents diffuse into the gelatine layer where they react with the peptide chains.

These two methods may also be combined with each other by adding a quantity of the hardening agent to the gelatine solution and by applying the rest to an already coated support material.

All substances usually utilized as hardening agents have specific areas of application and are usually not perfectly suited to other areas where they show one, or a number of disadvantages. Aliphatic aldehyde and diketone are not suitable for color photographic coatings because they may react with the usual color couplers or other emulsion additives. Polyepoxides, triazines and polysaccharides are highly suitable for color photographic coatings but have the disadvantage of reacting very slowly and are therefore not suitable for gelatine layers which may be put under mechanical stress within a short period after drying. Other hardening agents such as chromium salts react so quickly that a gelatine solution to which they have been added shows an increase in viscosity even during processing. There are again other hardening agents which are unsatisfactorily resistant to diffusion and they change the hardened condition of the adjacent layers during storage.

Every known hardening agent up to the present time has shown one or more disadvantages and is not suitable for a wide range of applications as is highly desirable when using auxiliary gelatine layers which are applied to a base material before emulsioning and later come into contact with the actual photographic coating.

The main disadvantage remains that the reaction of most hardening agents with gelatine is too slow, and further processing of the coated materials is only possible after days or weeks of storage.

The German Patent Disclosure Statement DE-A-3 721 808 describes quick hardening by means of the application of two coatings, one after the other, wherein the second or top coating is a hardening solution of chromium salts.

This document also gives the reasons why the water receptivity of the anti-curl layer is said to be lower than that of light-sensitive emulsion layers. The same document establishes how the water receptivity of the hardened anti-curl layer was ascertained gravimetrically by using a test strip treated for 10 minutes in distilled water at 22° C. and then dried.

According to the above mentioned document the water absorption target of anything less than 2.5 g $H_2O$ per 1 g gelatine can be obtained only by a separate coating of chrome (III)-salt-containing hardening solution. As a result, the backside of the light-sensitive support material, depending upon the thickness of the anti-curl layer, almost always showed an undesirable, weak, green discoloration.

Apart from that the application of two layers is more workintensive and risky than that of a single layer.

The hardening of binding agents containing protein, especially that of gelatine when using the usual hardening agents or using different combinations of hardening agents, is the state of technology when dealing with the usual requirements for emulsion- and auxiliary-layers. However, there is no one-step process for the manufacture of anti-curl layers which absorb less water than 2.5 g $H_2O$ per 1 g of gelatine without the application of chrome (III)-salts.

Furthermore the European Patent-Disclosure Statement EP-A-303 789 describes the synergistic effects of a hardening agent premix consisting of 1,2,3-triazine and formaldehyde. This premix achieves better and faster gelatine hardening than does the addition of single components without premixing. Example 3 of this patent disclosure shows the acceleration of the hardening reaction by the addition of urea. This mix, however, led to photographic fog when coming into contact with color emulsions. However, even these new hardening agent combinations were not able to produce an anti-curl layer with the low water receptivity required not even when additional aliphatic polyhydric alcohols were added to the anti-curl coating solution.

It is therefore the object of the present invention to develop a process for the manufacture of support material for light sensitive materials with a protein-containing anti-curl coating on the backside of the support material, whereby the water absorption rate of the hardened anti-curl layer remains below 2.5 g $H_2O$ per 1 g of protein, measured after 10 minutes of reaction time in distilled water at 22° C., and whereby this layer is applied in a one-step process without undesirable discoloring of the anti-curl layer.

It is a further object of the present invention to provide a process for the manufacture of this support material for light-sensitive materials in such a way that a non-fog photographic material is produced.

It is a further object of the present invention to make available a support material for light-sensitive materials on whose backside an anti-curl coating has been applied, the water receptivity of which is less than 2.5 g $H_2O$ per 1 g of protein, measured after 10 minutes of reaction time in distilled water at 22° C.

These objects are achieved by a support material for light-sensitive materials with an anti-curl layer on the backside which consists of the following components as minimum:

a) 100 weight parts of protein binder or protein-containing binding agent mixture,
b) 0.3–1.7 weight parts of a reaction product of triazine and formaldehyde in a weight ratio of 1:0.1 up to 1:0.7,
c) 2.1–5.5 weight parts of an N-methylol compound, and
d) 30–50 weight parts of an aliphatic polyhydric alcohol.

The quantities of the components in the triazine-formaldehyde-premix correspond to the German Patent Disclosure Statement DE-A-37 27 29j and are 1,3,5-triazine:formaldehyde = 1:0.1 up to 1:0.7.

The ratio of the triazine-formaldehyde-premix to the N-methylol compound amounts to 1:2.5 up to 1:10. The required quantity of complete hardening agent (triazine-formaldehyde-premix and N-methylol compound) is from 3–6 g/100 g of protein. The quantity of aliphatic polyhydric alcohol is from 30–50 g/100 g of protein.

The anti-curl coating solution may include all the usual further additives such as matting agents (e.g. silicic acid, anti-static agents (e.g. anorganic salts), optical brighteners (e.g. derivatives of stilbene), wetting agents (e.g. saponin) and other substances.

The anti-curl coating solution may be applied by any of the usual application processes, such as roll-, gravure- or nip-coating and usual dosing processes, such as air-brushing or wire bar.

In a particularly economical form of the process the anti-curl coating solution applied to the backside of the base material is dried directly from its sol form without any previous gelation of the solution.

It is surprising that a combination of the afore-mentioned additives should show such excellent and quick protein hardening as neither the same quantity of single components nor the favored premix of triazine and formaldehyde gave correspondingly good hardening results.

The following examples are intended to make the present invention clear but not to limit it.

EXAMPLE 1

A support material consisting of 175 g/m² base paper and a layer of 35 g/m² polyethylene on each side was coated with the following anti-curl solution:

| | | |
|---|---|---|
| Water | | 58.5% weight |
| Gelatine | | 8% weight |
| Sodium Nitrate | 10% solution | 7% weight |
| Silicon dioxide (Gasil 644) | 20% solution | 12.5% weight |
| Corn Starch (Fluidamid DF 12) | | 1% weight |
| Wetting Agent (Saponin Q) | 5% solution | 1% weight |
| TAF*/Formaldehyde (1:0.3) | 2% solution | 3% weight |
| Dimethylolurea | 5% solution | 6% weight |
| Ethylene Glycol | | 3% weight |

*TAF = 1,3,5-Triacryloyl-Hexahydro-s-Triazine

The anti-curl coating solution was applied to the backside of the polyethylene-coated support material by means of roll coaters and metering bar and was dried directly from its sol form in a hot-air tunnel at an air temperature of 130° C. Application weight after drying was 4.2 g/m². Coating speed was 130 meters per minute.

EXAMPLE 2

A support material consisting of 180 g/m² base paper and a polyethylene coat of 35 g/m² on the front side and of 28 g/m² on the backside was coated with the following anti-curl coating solution.

| | | |
|---|---|---|
| Water | | 54% weight |
| Gelatine | | 8% weight |
| Sodium Nitrate | 10% solution | 7% weight |
| Silicon dioxide (Gasil 644) | 20% solution | 13% weight |
| Wetting Agent (Saponin Q) | 5% solution | 1% weight |
| TAF*/Formaldehyde (1:0.5) | 2% solution | 2% weight |
| Trimethylolurea | 5% solution | 8% weight |
| Polyethylene Glycol (MG 400) | 50% solution | 5% weight |

*TAF = 1,3,5-Triacryloyl-Hexahydro-s-Triazine

The anti-curl coating solution was applied to the polyethylene-coated support material by means of air brushes, gelated in a cool zone at 8° C. air temperature and dried in two stages at air temperatures of 32° C. and 60° C. respectively. Coating speed was 130 meters per minute and coating weight after drying was 5.0 g/m².

EXAMPLE 3

A support material as in Example 1 was coated with an anti-curl coating solution as follows:

| | | |
|---|---|---|
| Water | | 58.6% weight |
| Gelatine | | 8% weight |
| Sodium Nitrate | 10% solution | 7% weight |
| Silicon dioxide (Gasil 644) | 20% solution | 13% weight |
| Wetting Agent (Saponin Q) | 5% solution | 1% weight |
| TAF*/Formaldehyde (1:0,4) | 2% solution | 3% weight |
| Trimethylol Melamine | 5% solution | 4.4% weight |
| Pentaerythritol | | 5% weight |

*TAF = 1,3,5-Triacryloyl-Hexahydro-s-Triazine

The anti-curl coating solution was applied to the backside of the polyethylene-coated support material by means of a kiss-roll coater and metering bar and was dried from its sol form in a hot-air tunnel at an air temperature of 130° C. Coating speed was 130 mpm and coating weight after drying was 3.7 g/m².

COMPARISON EXAMPLE V 1

A support material as in Example 1 was coated with the following anti-curl coating solutions:

| | | |
|---|---|---|
| Gelatine | | 8% weight |
| Sodium Nitrate | 10% solution | 7% weight |
| Silicon dioxide (Gasil 644) | 20% solution | 13% weight |
| Wetting Agent (Saponin Q) | 5% solution | 1% weight |

Further components used were:

| | water | TAF*:FA* = 1:0,4 2% solut. | DMH* 5% solut. | EG* | PEG* 4000 10% solut. |
|---|---|---|---|---|---|
| V1a | 50% weight | 18% weight | — | 3% weight | — |
| V1b | 60.8% weight | — | 7.2% weight | 3% weight | — |
| V1C | 32% weight | 3% weight | 6% weight | — | 30% weight |

TAF* = 1,3,5-Triacryloyl-hexahydro-s-triazine
FA* = Formaldehyde
DMH* = Dimethylolurea
EG* = Ethylene glycol
PEG* 4000 = Polyethylene glycol with a gram-molecular weight approx. 4000

The anti-curl coating solution was applied to the backside of the polyethylene-coated support material by means of a roll coater and doctor blade and was dried directly from its sol form in a hot-air tunnel at an air temperature of 130° C. Coating speed was 130 mpm and coating weight was 4.0 g/m$^2$±0.1 g.

COMPARISON EXAMPLE V 2

V 2a: A support material as in Example 1 was coated with the following anti-curl coating solution which corresponds to Example 1 of the German Patent Disclosure No. DE-A-37 21 808:

| | |
|---|---|
| Water | 84.75% weight |
| Gelatine | 12.00% weight |
| Sodium Nitrate | 1.00% weight |
| Silicon dioxide | 1.00% weight |
| Glycerine | 1.00% weight |
| Wetting Agent | 0.10% weight |
| Citric Acid | 0.02% weight |
| Chrome Alum | 0.10% weight |
| Triacryloylhexahydrotriazine | 0.03% weight |
| Sodium Hydroxide Solution up to pH 6.6 | |

It was applied, according to Example 1, to the backside of the support material and dried in a hot-air tunnel at an air temperature of 130° C. The coating weight was 5 g/m$^2$.

The first coating, when dried, was the surface onto which there was applied the following second coating:

| | |
|---|---|
| Chrome Alum | 5% weight |
| Polyvinyl alcohol, fully saponified, mean polymerization grade = 5100 | 1% weight |
| Water | 94% weight |

This second coating was applied as in Example 1 to the backside of the support material onto the first coating and dried in a hot-air tunnel at an air temperature of 130° C. Coating weight was 320 mg/m$^2$. The coating speed of both coatings was 100 mpm.

V 2b: A support material as in Example 1 was coated with the following anti-curl coating solution which is similar to mixtures 1 and 3 f of German Patent Disclosure Statement No. DE-A-37 27 293:

| | | |
|---|---|---|
| Water | | 66.1% weight |
| Gelatine | | 7.0% weight |
| Sodium Nitrate | 10% solution | 7.0% weight |
| Silicon dioxide | 20% solution | 12.5% weight |
| Wetting Agent | 5% solution | 1.0% weight |
| TAF/Formaldehyde (1:0.5) | 2% solution | 3.0% weight |
| Urea | 2% solution | 0.4% weight |
| Ethylene Glycol | | 3.0% weight |

The anti-curl coating solution was applied as in Example 1 to the backside of the polyethylene-coated support material and was dried from its sol form in a hot-air tunnel at an air temperature of 130° C. Coating speed was 100 mpm and coating weight was 4.0 g/m$^2$ after drying.

Test for Water Absorption

A test strip is submerged in distilled water at 22° C. for 10 minutes and then dried. The test strip is weighed before and after drying. The weight difference is referred to the quantity of gelatine present in the test strip. Gelatine quantity is calculated from mixture components, coating weight and size of test strip. Water absorption figures are in grams of water per gram of gelatine.

Test for Photographic Fog

Commercial color paper, in contact with the freshly-dried anti-curl layer is incubated for 5 days at 50° C. and then developed and fixed together with a blank test similarly treated. The degrees of fogging are then evaluated, "1" standing for "no difference" and "5"]standing for "substantial difference".

Test Results

| Example No. | Water absorption (g/lg gelatine) immediate | after 4 weeks | Photographic fog on contact with color emulsion | Color of the backside layer of the support material |
|---|---|---|---|---|
| 1 | 2.0 | 1.3 | 1–2 | white |
| 2 | 1.8 | 1.3 | 1 | white |
| 3 | 2.2 | 1.4 | 1–2 | white |
| V 1a | 3.7 | 2.9 | 3 | white |
| V 1b | 3.3 | 3.0 | 1–2 | white |
| V 1c | 3.0 | 2.4 | 1 | white |
| V 2a | 0.9 | 1.0 | 4 | pale green |
| V 2b | 3.1 | 2.6 | 4 | white |

It will be understood that the specification and examples are illustrative but not limitative of the present invention and that other embodiments within the spirit and scope of the invention will suggest themselves to those skilled in the art.

What is claimed is:

1. In a support material carrying a light sensitive material and an anti-curl layer on its backside, the improvement wherein the anti-curl layer comprises by weight a) 100 parts of a protein binder or a protein-containing binding agent mix, b) from 0.3 to 1.7 parts of a reaction-product of triazine and formaldehyde in a weight relationship of from 1.0 to 0.1 up to 1.0 to 0.7, c) from 2.1 to 5.5 parts of an N-methylol compound, and d) from 30 to 50 parts of an aliphatic polyhydric alcohol.

2. A support material according to claim 1 wherein the triazine is a 1,3,5-triazine.

3. A support material according to claim 1 wherein the N-methylol compound is a di- or tri-methylol urea or trimethylol melamine.

4. A support material according to claim 1 wherein the aliphatic polyhydric alcohol is of a molecular weight below 2000.

5. A support material according to claim 1 wherein the anti-curl layer contains as an additional additive at least one material selected from the group consisting of a matting agent, wetting agent, optical brightener, toning dye and anti-static agent.

* * * * *